US006165296A

United States Patent [19]

Mendenhall et al.

[11] Patent Number: 6,165,296

[45] Date of Patent: Dec. 26, 2000

[54] GAS GENERANT IGNITER COMPOSITION AND METHOD

[75] Inventors: Ivan V. Mendenhall, Providence; Robert D. Taylor, Hyrum; David W. Parkinson, N. Ogden; Gregory B. Hess, Hyrum, all of Utah

[73] Assignee: Autoliv Development AS, Vargarda, Sweden

[21] Appl. No.: 09/243,160

[22] Filed: Feb. 2, 1999

[51] Int. Cl.[7] ..... C06B 31/02; D03D 23/00

[52] U.S. Cl. ..... 149/61; 149/109.6

[58] Field of Search ..... 149/61, 109.6, 149/108.6; 280/741, 728.1

[56] References Cited

U.S. PATENT DOCUMENTS

| | | | |
|---|---|---|---|
| 3,794,535 | 2/1974 | Bertrand et al. | 149/3 |
| 5,273,313 | 12/1993 | Klober et al. | 280/741 |
| 5,345,873 | 9/1994 | Lauritzen et al. | 102/290 |
| 5,388,518 | 2/1995 | Wong | 102/289 |
| 5,404,813 | 4/1995 | Wong | 102/289 |
| 5,495,807 | 3/1996 | Klober et al. | 102/289 |
| 5,507,890 | 4/1996 | Swann et al. | 149/16 |
| 5,527,405 | 6/1996 | Schleicher et al. | 149/35 |
| 5,641,938 | 6/1997 | Holland et al. | 149/48 |
| 5,670,740 | 9/1997 | Barnes et al. | 149/62 |
| 5,682,013 | 10/1997 | Smith et al. | 149/6 |
| 5,695,216 | 12/1997 | Sandstrom et al. | 280/737 |
| 5,739,460 | 4/1998 | Knowlton et al. | 102/324 |
| 5,898,126 | 4/1999 | Yoshida | 149/46 |

*Primary Examiner*—Charles T. Jordan
*Assistant Examiner*—Aileen J. Baker
*Attorney, Agent, or Firm*—Sally J. Brown

[57] ABSTRACT

An igniter composition for a gas generant and related methods of gas generation are provided in which the igniter composition desirably avoids or is not prone to being ignited by thermal means at ambient pressure conditions.

11 Claims, 3 Drawing Sheets

GAS GENERANT IGNITER COMPOSITION AND METHOD

BACKGROUND OF THE INVENTION

This invention relates generally to gas generation and, more particularly to the ignition of gas generant materials such as used for the inflation of inflatable devices such as airbag cushions used in inflatable restraint systems for the protection of vehicle occupants.

It is well known to protect a vehicle occupant using a cushion or bag, e.g., an "airbag cushion," that is inflated or expanded with gas when the vehicle encounters sudden deceleration, such as in the event of a collision. In such systems, the airbag cushion is normally housed in an uninflated and folded condition to minimize space requirements. Such systems typically also include one or more crash sensors mounted on or to the frame or body of the vehicle to detect sudden decelerations of the vehicle and to electronically trigger activation of the system. Upon actuation of the system, a respective airbag cushion may begin to be inflated in a matter of no more than a few milliseconds with gas produced or supplied by a device commonly referred to as an "inflator."

Many types of inflator devices have been disclosed in the art for the inflating of one or more inflatable restraint system airbag cushions. Inflator devices which form or produce inflation gas via the combustion of a gas generating material are well known. It is also known that certain of such inflator devices may utilize such generated gas to supplement stored and pressurized gas such as by the addition of high temperature combustion products, including additional gas products, produced by the burning of the gas generating material to a supply of the stored, pressurized gas. In some cases, the combustion products produced by the burning of a gas generating material may be the sole or substantially the sole source for the inflation gas issuing forth from a particular inflator device.

It is common that inflator devices include an initiator, such as a squib, and an igniter. In practice, upon receipt of an appropriate triggering signal from a crash or other selected deceleration sensor, the initiator activates to cause the rapid combustion of the igniter material, which, in turn, serves to ignite the gas generant.

A common or standard igniter formulation employed for or in airbag inflators is composed of about 15 to about 30 weight percent (typically about 25 weight percent) boron and about 70 to about 85 weight percent (typically about 75 weight percent) potassium nitrate. In the art, this standard igniter formulation is commonly referred to as "$BKNO_3$."

While such an igniter formulation has in the past been generally useful and effective in various inflatable restraint system applications, certain improvements in performance may be desired at least in particular applications. For example, $BKNO_3$ igniter formulations are generally ignitable at ambient conditions of temperature and/or pressure. While the rapid ignitability of an igniter formulation is generally desired in typical inflatable restraint system applications, ignitability at ambient conditions may create or exacerbate risks, difficulties and related concerns regarding the processing and handling of such igniter formulations and devices which contain such formulations.

Thus, there is a need and a demand for improved igniter compositions such as suited for use in the ignition of gas generant materials used in association with vehicular inflatable restraint systems. In particular, there is a need and a demand for suitable such igniter compositions which are not readily ignitable by thermal means at ambient pressure.

SUMMARY OF THE INVENTION

A general object of the invention is to provide an improved igniter composition and related methods of gas generation.

A more specific objective of the invention is to overcome one or more of the problems described above.

The general object of the invention can be attained, at least in part, through an igniter composition which includes between about 60 to about 75 composition weight percent of an oxidizer selected from the group consisting of strontium nitrate and potassium nitrate and between about 25 to about 40 composition weight percent of an Al/Mg alloy fuel component and which igniter composition is free of a gas-producing fuel.

The prior art generally fails to provide igniter compositions and corresponding or associated methods of gas generation in which the igniter composition desirably avoids or is not prone to being ignited by thermal means at ambient pressure conditions. In particular, the prior art fails to provide igniter compositions and related methods of gas generation where the igniter composition is stable against thermal ignition at pressures up to at least about 200 psi.

The invention further comprehends an improvement in a method of generating gas involving the steps of reacting an ignition material to form ignition material reaction products and contacting a gas generant material with at least a portion of the ignition material reaction products whereby the gas generant material forms gaseous products. In the improved method of the invention, the ignition material is composed of an ignition material fuel and an ignition material oxidizer combination stable against thermal ignition at pressures up to at least about 200 psi.

As used herein, references to "thermal means" of ignition and the like are to be understood to refer to ignition by or upon exposure to one or more various thermal stimuli, including, for example, exposure to a hot wire, a flame or a flame source or the like.

Other objects and advantages will be apparent to those skilled in the art from the following detailed description taken in conjunction with the appended claims and drawings.

DETAILED DESCRIPTION OF THE INVENTION

Figure 1:
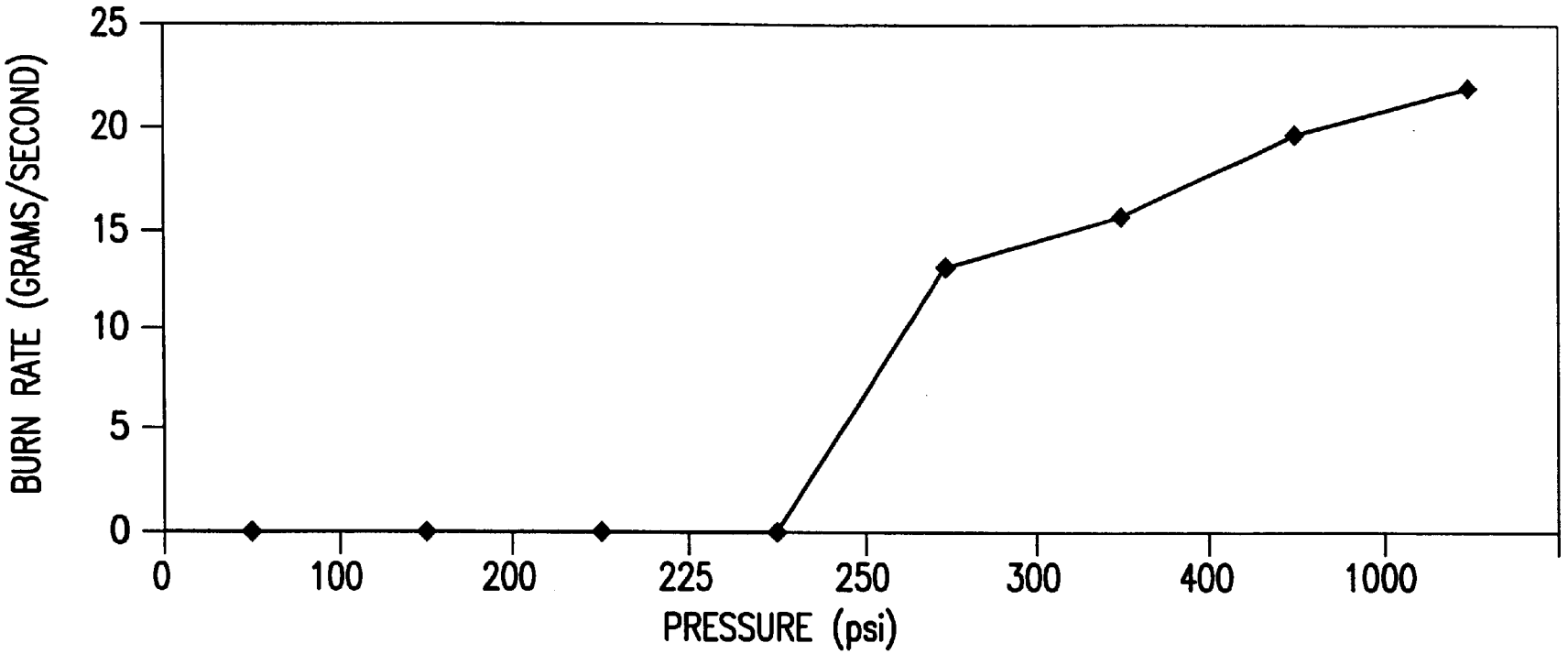
FIG. 1 is a graphical depiction of the burn rate as a function of chamber pressure for the igniter composition of Example 1, in accordance with one embodiment of the invention.

The present invention provides an igniter composition such as for a gas generant material used in the inflation of an inflatable device such as a vehicle occupant restraint airbag cushion. Such combustible igniter compositions are generally free of a gas producing fuel and typically include an Al/Mg alloy fuel component and an oxidizer component such as composed of strontium nitrate, an alkali metal nitrate (such as potassium nitrate, for example) or a combination thereof.

The primary fuel component of the subject igniter compositions is an alloy of aluminum and magnesium (herein sometimes referred to as an "Al/Mg alloy"). It has been found that increasing the magnesium content of such fuel component generally results in the formulation having increased ignitability as well as increased sensitivity to impact, friction and electrostatic discharge. In view of the increased sensitivity of higher magnesium content formulations, an Al/Mg alloy which contains about 50 to about 90 wt % Al and about 10 to about 50 wt % Mg, preferably about 50 to about 80 wt % Al and about 20 to about 50 wt % Mg and, at least in certain preferred embodiments, more preferably an Al content of about 70 percent and a Mg content of about 30 percent, will generally be preferred. In accordance with certain preferred embodiments of the invention, between about 25 to about 40 weight percent of the subject igniter composition generally constitutes such an Al/Mg alloy fuel component.

As identified above, igniter compositions in accordance with the invention are desirably free of gas producing fuel as the inclusion of gas producing fuels may tend to undesirably increase the sensitivity of the resulting composition to ignitability by thermal means at ambient pressure conditions.

Further, as identified above and as described in greater detail below, ignition material compositions in accordance with the invention desirably include an ignition material fuel and an ignition material oxidizer combination which is stable against thermal ignition at pressures up to at least about 200 psi, preferably at least about 220 psi and, more preferably, at least about 235 psi. As a result, such igniter compositions in accordance with the invention desirably avoid or are not prone to being ignited by thermal means at ambient pressure conditions. Thus, reducing risks, difficulties and related concerns associated with the processing and handling of such igniter compositions and the devices which contain such igniter compositions.

In accordance with certain preferred embodiments of the invention, between about 60 to about 75 percent of the subject igniter composition generally constitutes an oxidizer component, such as described above. The major oxidizer component is desirably selected for producing an easily filterable combustion product slag. In accordance with one preferred embodiment of the invention, at least about 50 wt % up to 100 wt % of the oxidizer component of the subject igniter composition comprises strontium nitrate. Strontium nitrate has been found to desirably produce condensible combustion products, such as strontium oxide, which have a relatively high-melting point. As will be appreciated, such high-melting temperature condensible combustion products can generally more easily be filtered or otherwise removed from the inflation gases produced or formed by an associated inflator device, as compared to igniter compositions such as standard $BKNO_3$ which produce or form low-melting temperature combustion products in relatively greater proportion.

The oxidizer component of such a preferred igniter composition may additionally include up to about 50 wt % of an alkali metal nitrate such as potassium nitrate. The igniter composition inclusion of an alkali metal nitrate such as potassium nitrate may be desired such as to increase the ignitability of the resulting igniter compositions. It will be understood, however, that as the inclusion of such alkali metal nitrate may, upon combustion, result in increased formation of combustion products which pass through filtering devices in the form of a gas and, condense and solidify into particulate material at exhaust conditions. Thus, to the extent possible, it may be desirable and preferred that the alkali metal nitrate content of the subject igniter compositions be reduced or minimized to the extent possible.

It will be appreciated, however, that when such igniter compositions are used in relatively small amounts or quantities, particulate production such as associated with the formation of significant amounts or quantities of condensible products may not be as significant an issue. In view thereof, igniter compositions constituting an oxidizer component containing in excess of about 50 wt %, up to about 100 wt %, of an alkali metal nitrate such as potassium nitrate may be used in accordance with certain other preferred embodiments of the invention.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Example 1

In these trials, the burn rate of an igniter composition in accordance with the invention as a function of pressure was evaluated.

More specifically, a one gram sample of an igniter composition containing 68.58 wt % strontium nitrate and 31.42 wt % of an Al/Mg alloy with an Al content of 70 percent and a Mg content of 30 percent was placed in a metal cup. The igniter composition-containing cup was placed in a 1 liter closed pressure chamber or vessel capable of being pressurized with nitrogen gas to several thousand psi. The pressure chamber was equipped with a pressure transducer for accurate measurement of pressure within the pressure chamber.

An ignition wire was passed through the igniter composition sample and connected to electrodes mounted in the lid of the pressure chamber. The pressure chamber was then pressurized to the desired pressure and an ignition current passed through the ignition wire. Pressure vs. time data was collected as the sample burned. Upon ignition, a small amount of nitrogen gas was formed or produced by the strontium nitrate oxidizer. As a result, an increase in the pressure of the chamber signaled the start of combustion and a "leveling off" of pressure signaled the end of combustion. The time required for combustion (i.e., combustion time) corresponded to $t_2-t_1$, where $t_2$ was the time at the end of combustion and $t_1$ was the time at the start of combustion. The sample weight was divided by combustion time to yield the burning rate in grams per second.

Discussion of Results

FIG. 1 is a plot of burn rate versus pressure in the closed chamber, obtained in Example 1. As shown, there was no ignition of the igniter composition by the hot wire until the pressure in the tank reached a level of about 235 psi. As will be appreciated, this characteristic of the subject igniter composition generally makes such igniter composition safer to handle or process, as compared to typical igniter formulations, such as $BKNO_3$, for example.

Example 2 and Comparative Example 1

In these Examples, 30 grams of gas generant tablets (diameter =⅜ in., thickness =0.110 in.) composed of 47.21 wt % guanidine nitrate, 40.62 wt % ammonium nitrate, 7.17 wt % copper diammine dinitrate and 5.00 wt % silicon dioxide were coated with the igniter composition of Example 1 (i.e., Example 2) and a standard igniter composition containing 25 wt % boron and 75 wt % potassium nitrate (i.e., Comparative Example 1), respectively. In each case, the respective igniter composition was applied in a relative amount such that the igniter composition constituted 7% of the total weight of the ignition-enhanced (e.g., coated) gas generant.

Each of the respective ignition enhanced gas generant materials was then loaded into an inflator simulator test fixture (i.e., a reusable steel hardware designed to simulate an airbag inflator assembly). The test fixture was equipped with a squib for igniting the sample ignition enhanced gas generant material and a pressure transducer was mounted in the side of the fixture to permit dynamic (real-time) pressure measurements within the combustion chamber of the test fixture. The inflator simulator was screwed into the lid of a 60 liter-closed tank also equipped with a pressure transducer for dynamic (real-time) measuring of pressure within the tank. The sample ignition enhanced gas generant materials contained within the inflator simulator in these Examples was respectively ignited by passing a current through a bridgewire in the squib and pressure vs. time data was collected from the transducer in the combustion chamber and in the tank, respectively.

Discussion of Results

Figure 2:
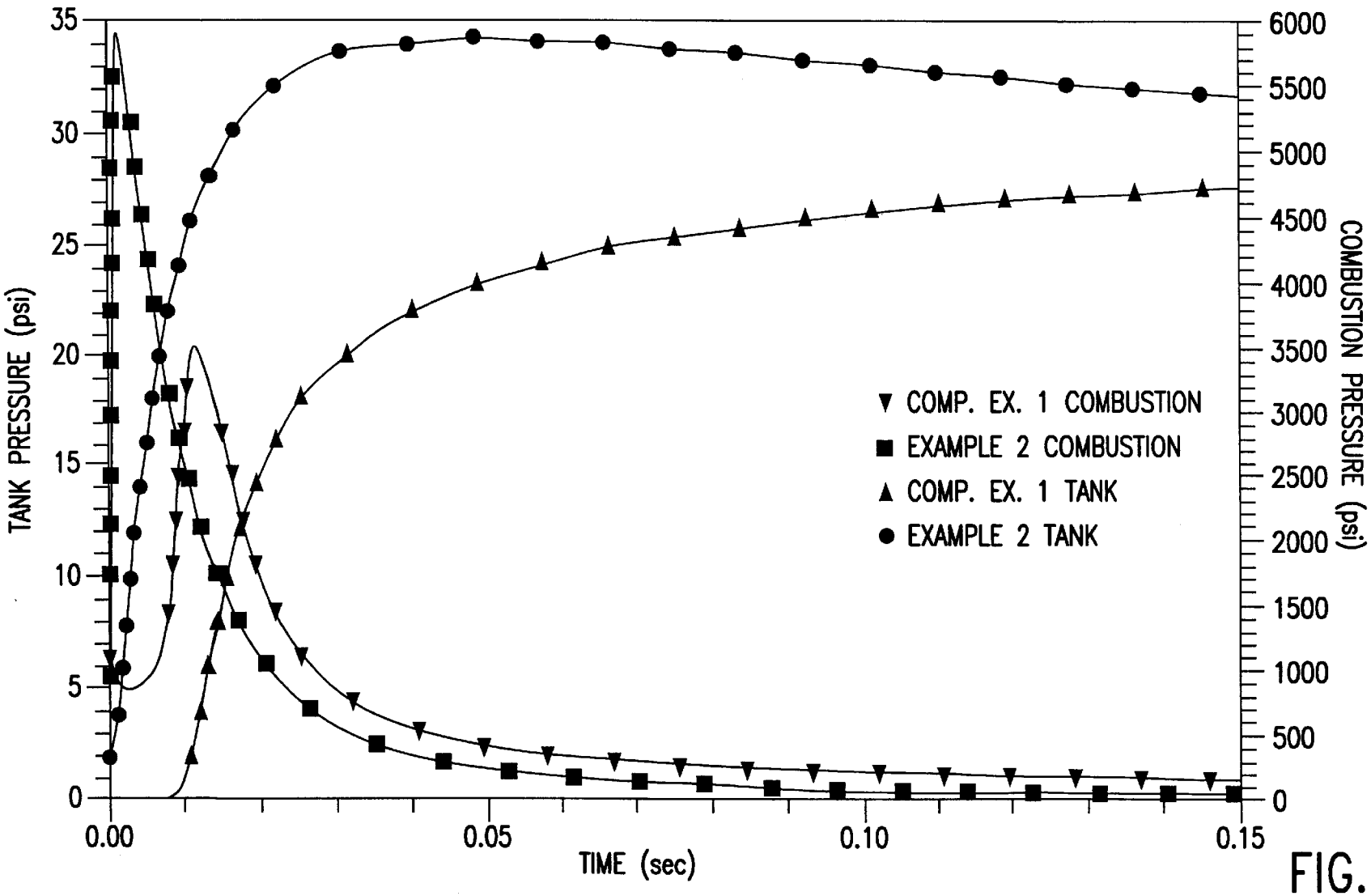
FIG. 2 is a graphical depiction of the combustion chamber and the tank pressures as a function of time performances realized for a gas generant coated with an igniter composition in accordance with the invention (Example 2) as compared to the same composition of gas generant coated with a standard gas generant igniter composition (Comparative Example 1).

FIG. 2 is a graphical depiction of the combustion chamber and the tank pressures as a function of time performances realized for a gas generant coated with an igniter composition in accordance with the invention (Example 2) as compared to the same composition of gas generant coated with a standard gas generant igniter composition (Comparative Example 1).

Figure 3:
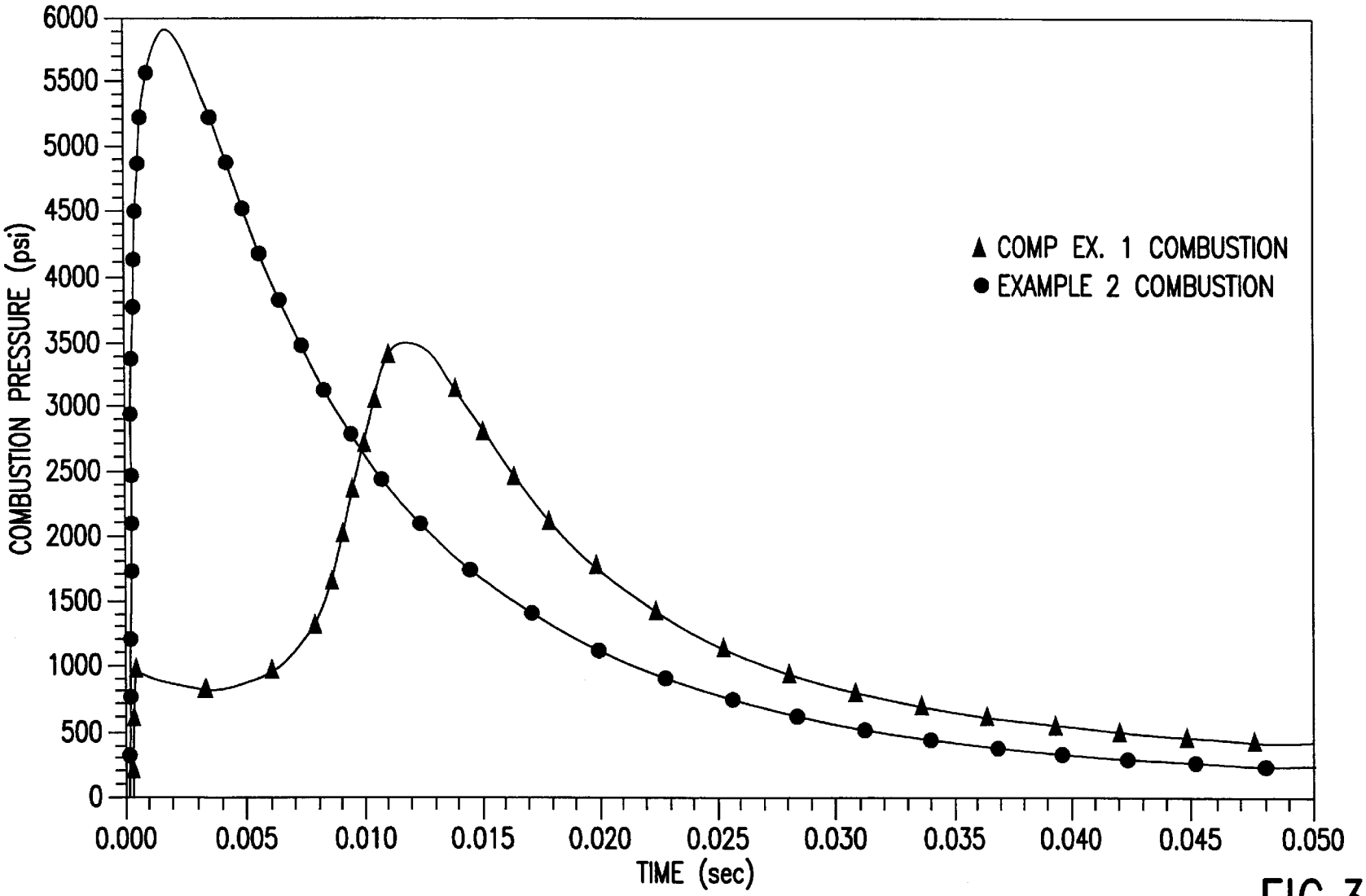
FIG. 3 is an expanded scale version of the combustion chamber pressure as a function of time performance realized for a gas generant coated with an igniter composition in accordance with the invention (Example 2) as compared to the same composition of gas generant coated with a standard gas generant igniter composition (Comparative Example 1), shown in FIG. 2.

FIG. 3 is an expanded scale version of the combustion chamber pressure as a function of time performance realized for a gas generant coated with an igniter composition in accordance with the invention (Example 2) as compared to the same composition of gas generant coated with a standard gas generant igniter composition (Comparative Example 1), shown in FIG. 2.

As shown in FIGS. 2 and 3, the gas generant coated with the igniter composition in accordance with the invention (Example 2) desirably demonstrated a more immediate response, i.e., a more rapid increase in combustion chamber pressure, as compared to the same composition of gas generant coated with a standard gas generant igniter composition (Comparative Example 1). Further, the gas generant coated with the igniter composition in accordance with the invention (Example 2) more quickly attained a peak tank pressure. As will be appreciated, such rapid performance can be very important for side impact applications where speed of response can be especially significant. Thus, igniter compositions and correspondingly ignition enhanced gas generants in accordance with the invention may have particular utility in association with side impact inflatable restraint applications where the time period for response may be even more significantly limited than typical driver side or passenger side inflatable restraint applications.

In view of the above, it is to be appreciated that the invention provides an improved igniter composition and related methods of gas generation which desirably overcome one or more of the problems described above. More particularly, the invention provides such igniter compositions and corresponding or associated methods of gas generation in which the igniter composition desirably avoids or is not prone to being ignited by thermal means at ambient pressure conditions.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. In a method of generating gas comprising the steps of reacting an ignition material to form ignition material reaction products and contacting a gas generant material with at least a portion of the ignition material reaction products whereby the gas generant material forms gaseous products the improvement comprising:

the ignition material comprising an ignition material fuel and an ignition material oxidizer combination stable against thermal ignition at pressures up to at least about 200 psi, wherein the ignition material fuel comprises an Al/Mg alloy.

2. The improvement of claim 1 wherein the ignition material oxidizer comprises potassium nitrate.

3. The improvement of claim 1 wherein the ignition material oxidizer comprises strontium nitrate.

4. The improvement of claim 1 wherein the ignition material comprises strontium nitrate in a relative amount of between about 60 to about 75 weight percent and the Al/Mg alloy fuel in a relative amount of between about 25 to about 40 weight percent, wherein the Al/Mg alloy fuel has an Al content of between about 50 to about 90 percent and a Mg content of between about 10 to about 50 percent.

5. A method of generating gas for the inflation an associated inflatable restraint, the method comprising the steps of:

reacting an ignition material containing between about 25 to about 40 composition weight percent of an Al/Mg alloy fuel component and between about 60 to about 75 composition weight percent of an oxidizer component, wherein at least about 50 wt % up to 100 wt % of the oxidizer component is strontium nitrate, to form ignition material reaction products and contacting a gas generant material with at least a portion of the ignition material reaction products whereby the gas generant material forms gaseous inflation products.

6. The method of claim 5 wherein the ignition material is free of a gas-producing fuel.

7. The method of claim 5 wherein the ignition material is stable against thermal ignition at pressures up to at least about 220 psi.

8. The method of claim 5 wherein the ignition material is stable against thermal ignition at pressures up to at least about 200 psi.

9. The method of claim 5 wherein the ignition material oxidizer component additionally includes up to about 50 wt % of an alkali metal nitrate.

10. The method of claim 5 wherein the associated inflatable restraint is in the form of a side impact inflatable restraint.

11. The improvement of claim 1 wherein the ignition material fuel and oxidizer combination is stable against thermal ignition at pressures up to at least about 220 psi.

* * * * *